US007984926B2

(12) United States Patent
Mallol et al.

(10) Patent No.: US 7,984,926 B2
(45) Date of Patent: Jul. 26, 2011

(54) SECURITY DOCUMENT AND/OR A DOCUMENT OF VALUE

(75) Inventors: Stephane Mallol, Provins (FR); Ivan Thierry, Jony sur Morin (FR)

(73) Assignee: Arjowiggins Security, Issy les Moulineaux (FR)

( * ) Notice: Subject to any disclaimer, the term of this patent is extended or adjusted under 35 U.S.C. 154(b) by 1092 days.

(21) Appl. No.: 11/628,729

(22) PCT Filed: Jun. 6, 2005

(86) PCT No.: PCT/FR2005/050420

§ 371 (c)(1),
(2), (4) Date: Mar. 29, 2007

(87) PCT Pub. No.: WO2005/124022

PCT Pub. Date: Dec. 29, 2005

(65) Prior Publication Data

US 2008/0030020 A1 Feb. 7, 2008

(30) Foreign Application Priority Data

Jun. 8, 2004 (FR) ..... 04 51137

(51) Int. Cl.
*B42D 15/00* (2006.01)
*B42D 15/10* (2006.01)

(52) U.S. Cl. ..... 283/72; 283/57; 283/91; 283/109; 283/901; 283/902

(58) Field of Classification Search ..... 283/57, 283/61, 62, 72, 83, 91, 100, 107, 109, 117, 283/901, 902, 904
See application file for complete search history.

(56) References Cited

U.S. PATENT DOCUMENTS

| | | | | |
|---|---|---|---|---|
| 5,068,008 | A | 11/1991 | Crane | |
| 5,176,405 | A | 1/1993 | Kaule et al. | |
| 5,275,870 | A | 1/1994 | Halope et al. | |
| 5,876,068 | A | 3/1999 | Schneider et al. | |
| 6,089,614 | A | 7/2000 | Howland et al. | |
| 2008/0122217 | A1 * | 5/2008 | Rancien et al. | 283/72 |

FOREIGN PATENT DOCUMENTS

| | | | |
|---|---|---|---|
| DE | 39 15 638 | A1 | 11/1990 |
| EP | 0 536 855 | A2 | 4/1993 |
| GB | 2 250 473 | A | 6/1992 |
| GB | 2250473 | A * | 6/1992 |
| WO | WO 91/07285 | A1 | 5/1991 |

* cited by examiner

*Primary Examiner* — Shelley Self
*Assistant Examiner* — Justin V Lewis
(74) *Attorney, Agent, or Firm* — Oliff & Berridge, PLC

(57) ABSTRACT

The present invention relates to a security document and/or document of value comprising:
at least one information vector; and
at least one masking element in the form of a strip having at least one semi-reflecting region covering the information vector at least in part, the masking element being of a width that is less than the width of the document.

37 Claims, 3 Drawing Sheets

SECURITY DOCUMENT AND/OR A DOCUMENT OF VALUE

The present invention relates in particular to a security document and/or a document of value.

European patent EP 0 536 855 discloses a security thread made of translucent plastics material and carrying inscriptions obtained by depositing metal. The security thread is for embedding completely within a layer of paper. The inscriptions then cannot be detected in reflected light but only in transmitted light. Nevertheless, when the thickness of the paper between the security thread and the outside face of the layer of paper is too small, the inscriptions can become visible in reflected light. In addition, since the inscriptions are made by depositing metal, the available shapes and colors are relatively limited.

U.S. Pat. No. 6,089,614 discloses paper with a printed pattern on one face that is covered by an iridescent patch. The patch is stuck onto the document and serves to make the pattern undetectable in reflected light. In transmitted light, the patch allows the pattern to be seen, which pattern co-operates with another pattern on an opposite face of the document to form a composite pattern.

The present invention seeks in particular to make it easier to fabricate security documents and/or documents of value while providing a wider selection of pattern types.

The invention thus provides a security document and/or document of value comprising:

at least one information vector; and at least one masking element in the form of a strip having at least one semi-reflecting region covering the information vector at least in part, the masking element being of a width that is less than the width of the document.

The term "semi-reflecting region" designates a region that makes the underlying information vector undetectable in reflected light, while being sufficiently transparent to make the information vector visible in transmitted light.

By means of the invention, the strip masking element can be incorporated or transferred relatively easily in or onto the document.

The masking element serves to protect information against reproduction, in particular by photocopying, thus improving the protection of the document against falsification.

The invention thus provides second level security, detectable only in transmitted light, in addition to first level securities of the kind visible in reflected light, such as a holographic element, for example.

In addition, the information vector may present a variety of shapes and/or colors.

In particular, the information vector may be made without depositing metal or without removing metal from a deposit.

In an embodiment, the masking element is semi-reflecting over a fraction only of its surface, e.g. including at least one region that is opaque to light and that surrounds a semi-reflecting window. In a variant, the masking element is semi-reflecting over its entire surface.

In an embodiment of the invention, the masking element comprises a semi-reflecting coating, the semi-reflecting coating possibly comprising one or more metals, in particular. The semi-reflecting coating may be made up of dots or a screen of a metal or of dots or a screen where metal has been removed. In another variant, the semi-reflecting coating comprises a layer of metal of thickness that is sufficiently small to enable light to be transmitted through said layer of metal, which layer of metal may present thickness lying in the range about 50 nanometers (nm) to 150 nm, and in particular close to 100 nm.

The semi-reflecting coating may comprise iridescent pigments, in particular selected from: extracts from mother-of-pearl; salts of lead; and micas.

The semi-reflecting coating may optionally be composite, comprising a plurality of materials, in particular metals.

In an embodiment of the invention, the semi-reflecting coating on the information vector comprises dots or a screen of metal or of places where metal has been removed.

The masking element may comprise a support on which the semi-reflecting coating is deposited, the information vector being carried in particular by the support.

The support may be flexible and/or transparent, e.g. being made of a plastics material, in particular of polyester.

The document may include two supports with the information vector being placed between them.

In an embodiment of the invention, only one of the supports carries a semi-reflecting coating. In a variant, both supports carry respective semi-reflecting coatings.

The semi-reflecting coating may be placed between the support and the information vector, or in a variant it may be placed on a face of the support opposite from the side adjacent to the information vector.

The support may be embedded at least in part, and in particular completely, in a layer of the document. In a variant, the support comes flush with a face of the document.

In an embodiment of the invention, the document includes a multilayer structure transferred onto the surface of the document, the multilayer structure comprising a semi-reflecting coating and the information vector. The multilayer structure may include a layer of varnish.

In another embodiment of the invention, the masking element comprises a semi-reflecting film, e.g. an iridescent film. The information vector may be carried by the semi-reflecting film, or in a variant, it may be made on the document.

In an embodiment of the invention, the information vector comprises printing an ink, which printing may be negative or positive.

The information vector may be colored, or in a variant it may be black and white.

The information vector may carry at least one of the following patterns: a word; a drawing; a symbol.

In an embodiment of the invention, the information vector carries a plurality of identical patterns, that are spaced apart in regular or random manner.

The masking element may include a plurality of semi-reflecting windows, the windows and the patterns optionally coinciding in regular manner, i.e. the windows revealing the same portions of the patterns.

In a variant, the windows and the patterns coincide in irregular manner, i.e. revealing different portions of the patterns.

In an embodiment of the invention, the document, in particular the masking element or the information vector further includes at least one of the following elements:

an electronic chip;

a holographic and/or diffractive element;

a watermark;

a magnetic or crystalline coating;

liquid crystals;

printed varnish;

biomarkers;

a luminescent and/or fluorescent ink or substance; and thermochromic and/or piezochromic pigments.

The masking element may present thickness lying in the range 6 micrometers (μm) to 60 μm, for example.

The masking element may present width, e.g. greater than 0.7 millimeters (mm), and preferably less than 60 mm, better lying in the range 1 mm to 25 mm.

The masking element may present width that is not constant, e.g. having at least one longitudinal edge that is not entirely rectilinear.

The document may comprise at least one fiber layer, or in a variant at least one layer of plastics material.

The masking element may extend from a first edge of the document to a second edge opposite from the first.

In an embodiment of the invention, the document does not have patterns that are suitable for co-operating with the information vector as masked by the masking element to define a composite pattern when the document is observed in transmitted light.

The document may constitute one of the following elements: a banknote; a security paper; a coupon; a document of value; a label for protecting a trademark or goods; a traceability label.

The invention also provides a strip structure for being incorporated in or transferred at least in part onto a document of width greater than the width of the structure, the structure being characterized by the fact that it comprises:

at least one information vector; and at least one masking element having at least one semi-reflecting region covering the information vector at least in part.

The masking element may comprise a semi-reflecting coating and optionally a support carrying the semi-reflecting coating.

In an embodiment of the invention, the semi-reflecting coating and the information vector remain secured to the support once the masking element is incorporated in the article.

In a variant, the support is arranged to be separated from the semi-reflecting coating after the structure has been transferred onto the document.

Between the support and the semi-reflecting coating, the structure may include at least one release layer. The structure may also include a layer of varnish, in particular between the release layer and the semi-reflecting coating.

In another embodiment of the invention, the masking element comprises a semi-reflecting film and the information vector can be made on said semi-reflecting film.

The invention also provides a method of fabricating a security document and/or a document of value, the method comprising the following steps:

forming a structure as specified above; and incorporating or transferring at least part of the structure in or onto the document.

When the document has a fiber layer, the method may comprise the following steps:

forming the fiber layer by depositing fibers on a surface immersed in a dispersion of fiber material; and bringing the strip structure into contact with the fiber layer while it is being formed.

The invention also provides a method of fabricating a security document and/or a document of value, comprising the following steps:

providing a structure as specified above;

transferring the information vector and the semi-reflecting coating onto the surface of the document; and after the transfer, separating the support from the information vector and the semi-reflecting coating.

The invention also provides a method of fabricating a security document and/or a document of value, comprising the following steps:

making an information vector on the document; and then transferring onto the document a masking element in the form of a strip of width that is smaller than the width of the document so as to cover the information vector, at least in part.

In another of its aspects, the invention also provides a security document and/or a document of value including:

at least one information vector carrying information that is complete; and at least one masking element having at least one semi-reflecting region completely covering the information vector.

The term "information that is complete" is used to mean information that can be revealed completely and independently of other information vectors, for example unlike partial images made on opposite faces of a document that together form a composite image in transmitted light.

In an embodiment of the invention, the masking element extends over a fraction only of one face of the document, and may be in the form of a patch, for example.

In particular, the masking element need not be in contact with any of the edges of the document.

In another of its aspects, the invention also provides a structure, in particular a strip, for transferring in part onto a security document and/or a document of value, the structure comprising:

at least one support; and at least one semi-reflecting coating carried by the support, which support is arranged to be separated from the semi-reflecting coating after the structure has been applied onto the document.

The portion of the structure for transferring onto the document preferably does not extend over a complete face of the support.

In an embodiment of the invention, the support presents a strip shape and carries a plurality of semi-reflecting regions spaced apart along the longitudinal axis of the support, each semi-reflecting region being in the form of a patch, for example.

The above-specified structure can carry one or more information vectors, made in particular on the semi-reflecting coating.

In a variant, the structure does not have an information vector.

In another of its aspects, the invention also provides a method of fabricating a security document and/or a document of value, the method comprising the following steps:

providing a structure as specified above; and transferring the semi-reflecting coating onto a surface of the document.

By way of example, the semi-reflecting coating can be transferred by localized application of pressure and/or heat on the structure.

In another of its aspects, the invention also provides a security document and/or a document of value including:

at least one information vector reproducing a plurality of identical patterns that are spaced apart from one another in a longitudinal direction; and at least one masking element having at least one semi-reflecting region covering the information vector at least in part.

In another of its aspects, the invention also provides a strip structure for being transferred in part onto a document, the structure comprising:

at least one information vector; and at least one masking element having at least one semi-reflecting region covering the information vector at least in part, the masking element comprising a support carrying the semi-reflecting coating, the support being arranged to be separated from the semi-reflecting coating after the structure has been applied on a document.

The invention can be better understood on reading the following detailed description of non-limiting embodiments thereof, and on examining the accompanying drawings, in which.

Figure 1:
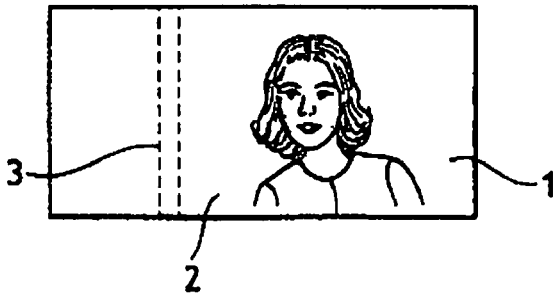
FIG. 1 is a diagrammatic and fragmentary view of an example of a document in accordance with the invention.

In the drawings, for reasons of clarity, the various elements are not always shown with their relative proportions to scale, the views being diagrammatic.

FIG. 1 shows a document 1 in accordance with the invention, e.g. constituting a banknote. The document 1 comprises one or more fiber layers 2 in which or between which there is incorporated a strip security structure 3 in accordance with the invention. In a variant, the document 1 may comprise one or more layers of plastics material.

Figure 5:
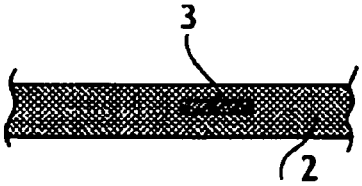
FIGS. 5 to 7 are diagrammatic and fragmentary cross-section views of documents respectively constituting three embodiments of the invention.

In the example described, the structure 3 is completely embedded in a fiber layer 2, as can be seen in FIG. 5.

Figure 6:
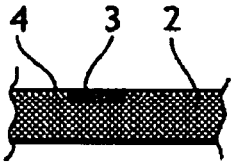

In a variant, as shown in FIG. 6, the structure 3 comes flush with one of the faces 4 of the document 1.

Figure 7:
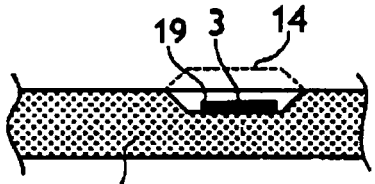

In another variant, as shown in FIG. 7, the structure 3 is partially embedded in the fiber layer 2 so as to present in alternation both portions that are embedded and portions that are uncovered. For this purpose, the fiber layer 2 may include setbacks 19 leaving portions of the structure 3 uncovered. Where appropriate, the fiber layer 2 may include projections 14 situated between the setbacks 19, and represented by a dashed line in FIG. 7.

The security structure 3 constitutes a thread of width that is smaller than that of the document 1. By way of example, the structure 3 presents a width lying in the range 0.7 mm to 60 mm.

Figure 2:
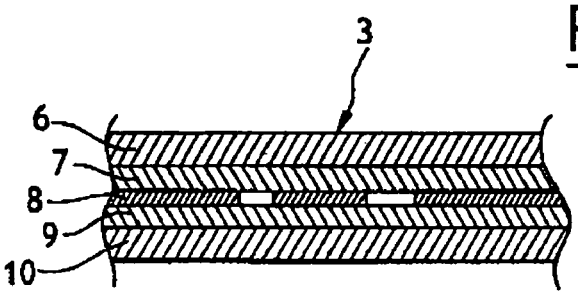
FIG. 2 is a diagrammatic and fragmentary cross-section view of a strip structure constituting an embodiment of the invention for incorporation in the document of FIG. 1.

As shown in FIG. 2, the structure 3 may comprise, going from its top face to its bottom face:

a first support 6, e.g. of polyester;

a first semi-reflecting coating 7;

an information vector 8;

a second semi-reflecting coating 9; and a second support 10, e.g. of polyester.

The semi-reflecting coatings 7 and 9 can be made in various ways, and they are preferably obtained by depositing a metal, either chemically or in a vacuum. The metal may be aluminum, cobalt, or nickel, for example.

The metal may be deposited as dots using a mask directly on the support 6 or 10, with the density of the dots or screen being selected in such a manner as to make the corresponding support semi-reflecting.

In a variant, the semi-reflecting coating 7 or 9 can be obtained by removing metal from portions of the support 6 or 10 after it has been previously been metallized, so as to form dots or a screen having an appropriate density. Metal can be removed, for example, by chemical etching or by cleaning away non-adhering metal particles.

In another variant, the coating 7 or 9 may be obtained by depositing a layer of metal on the support 6 or 10 to a thickness that is sufficiently small to allow light to be transmitted through the layer of metal. By way of example, the layer of metal may present a thickness close to 100 nm.

Figure 3:
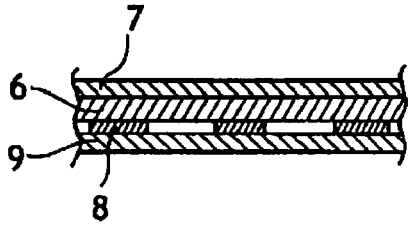
FIG. 3 is a diagrammatic and fragmentary cross-section view of a strip structure in another embodiment of the invention.

In a variant shown in FIG. 3, metal deposition or removal 9 takes place directly on the information vector 8.

In the example described, the other semi-reflecting coating 7 is not deposited between the support 6 and the information vector 8, but rather on the opposite face of the support 6 overlying the information vector 8, such that this semi-reflecting coating 7 constitutes an outer layer of the structure.

One of the semi-reflecting coatings may be an inner layer and the other may be an outer layer of the structure.

In another embodiment of the invention, the semi-reflecting coating 7 or 9 comprises iridescent pigments selected in particular from: extracts of mother-of-pearl, salts of lead, and micas.

By way of example, the structure 3 can be integrated in the document 1 during fabrication thereof.

Figure 4:
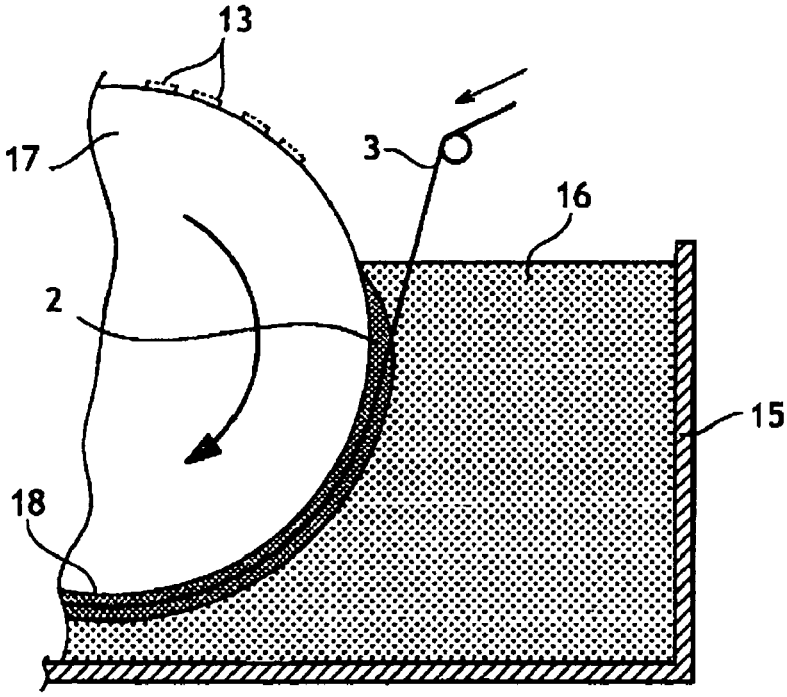
FIG. 4 is a diagram showing a step in the method of fabricating the FIG. 1 document in an implementation of the invention.

FIG. 4 is a fragmentary and diagrammatic view of a papermaking cylinder machine.

The machine comprises a vat 15 containing a suspension 16 of fibers, e.g. cellulose fibers and/or cotton linters and/or synthetic and/or artificial fibers, in which a rotary wire cylinder 17 is partially immersed and defines a surface 18 in contact with which the fiber layer 2 is formed continuously.

The structure 3 can be incorporated in the fiber layer 2 while it is being formed.

When the fiber layer 2 includes projections 14 as described above, the cylinder 17 has portions in relief 13, represented by dashed lines in FIG. 4, these portions in relief 13 being constituted, for example, by projections on the cylinder 17 or by one or more masks.

In the example described, the information vector 8 comprises printing in ink.

The printing may be positive or negative.

When printing is positive, the pattern reproduced by the information vector 8 can be colored.

When printing is negative, the information vector 8 may include a colored background.

In a variant, the information vector 8 may be in black and white.

In the example of FIGS. 8 to 12, the information vector 8 reproduces patterns 20 constituted by text.

The patterns 20 could equally well be a drawing or a symbol, for example.

In the example described, the information vector 8 reproduces identical patterns 20 that are regularly spaced apart along the security element 3.

In a variant, the spacing could be random.

The structure 3 may include at least one opaque region 22 surrounding windows 21 in which the semi-reflecting coating 7 or 9 extends, as shown in FIGS. 8, 9, 11, and 12.

The opaque region 22 may be constituted by an opaque layer that is not shown, e.g. of black ink, deposited between the support 6, 10 and the semi-reflecting coating 7, 9, for example.

Figure 9:
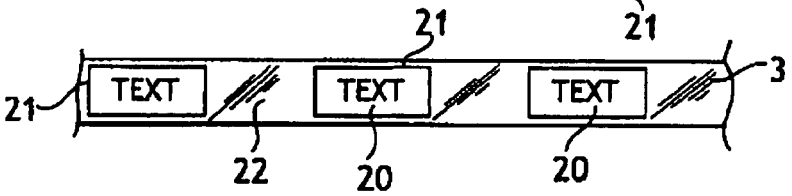
Figure 11:
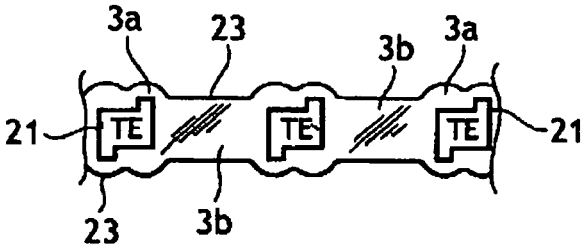
Figure 12:
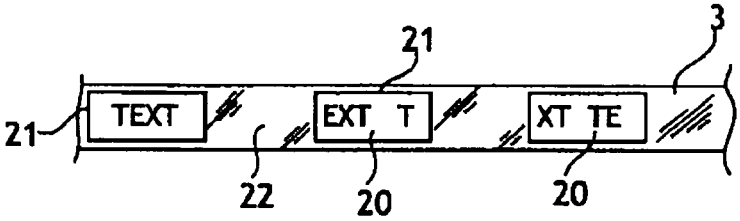

These windows 21, which may be spaced apart in regular or random manner, are situated in register with the patterns 20 so that by placing the document 1 between a light source and the observer, the observer can see the patterns 20 in the windows 21, as shown in FIGS. 9, 11, and 12.

In the example shown in FIG. 9, the windows and the patterns coincide in regular manner, i.e. the windows reveal the same portions of the patterns.

In a variant, in the example of FIG. 12, the windows and the patterns coincide in irregular manner, i.e. revealing different portions of the patterns.

Figure 8:
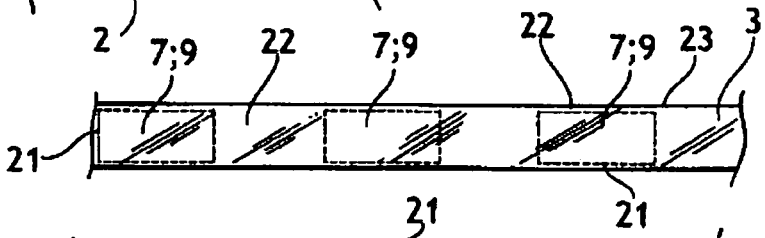
FIGS. 8 to 12 are diagrammatic and fragmentary views showing different embodiments of the masking elements.

In reflected light, i.e. when the light source and the observer are both situated on the same side of the document 1, the patterns 20 cannot be detected, as shown in FIG. 8.

Figure 10:
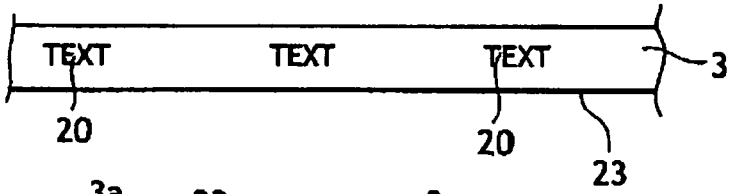

In a variant, the semi-reflecting coating 7 or 9 makes the corresponding support 6 or 10 semi-reflecting over its entire area. Thus, and as shown in FIG. 10, in transmitted light the security element 3 does not have any opaque zones.

The security element 3 may be of constant width, having longitudinal edges 23 that are rectilinear and substantially parallel, as shown in FIGS. 8 to 10, and 12. In a variant, as shown in FIG. 11, the security element may present varying width, e.g. with edges 23 that are not completely rectilinear, defining wider portions 3*a* alternating with narrower portions 3*b*.

In the example described, the security element has windows 21 situated in the wider portions 3*a*.

Figure 13:
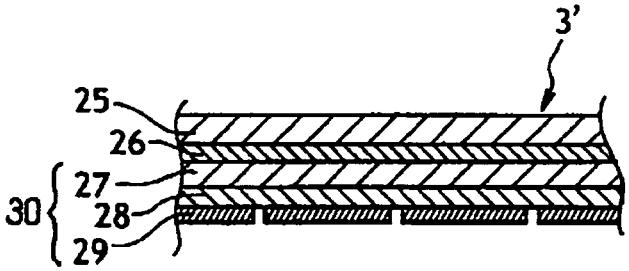
FIG. 13 is a diagrammatic and fragmentary cross-section view of a strip structure constituting another embodiment of the invention.

FIG. 13 shows a strip structure 3' constituting another embodiment of the invention.

This structure 3', also referred to as a "foil", comprises:

a support 25, e.g. of polyester;

a release layer 26, e.g. of wax;

a varnish layer 27 containing a resin and possibly also a dye;

a semi-reflecting coating 28 analogous to the above-described coating 7 or 9; and an information vector 29 analogous to the vector 20 described above.

Figure 14:
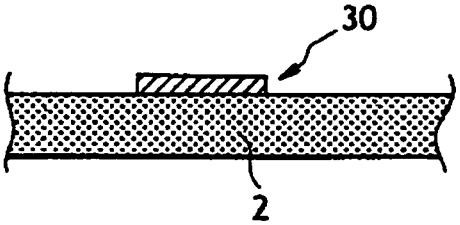
FIG. 14 is a diagrammatic and fragmentary cross-section view of a document including the strip structure of FIG. 13.

The varnish layer 27, the semi-reflecting coating 28, and the information vector 29 form an assembly 30 for transferring, e.g. onto a fiber layer 2, as shown in FIG. 14.

Figure 15:
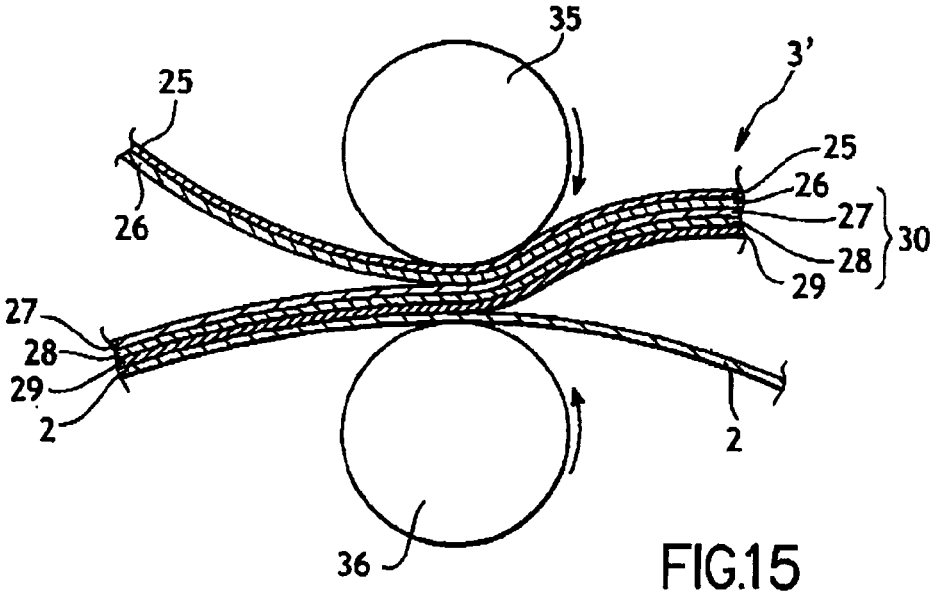
FIG. 15 is a diagrammatic view showing a step in the method of fabricating the document of FIG. 14 in an implementation of the invention.

The assembly 30 may be transferred in particular by applying heat, as shown in FIG. 15. The layer 2 and the structure 3' are then caused to travel in the same direction through a machine having first and second rotary cylinders 35 and 36. After passing therethrough, the support 25 and the release layer 26 are separated from the assembly 30 which remains secured to the layer 2.

Figure 16:
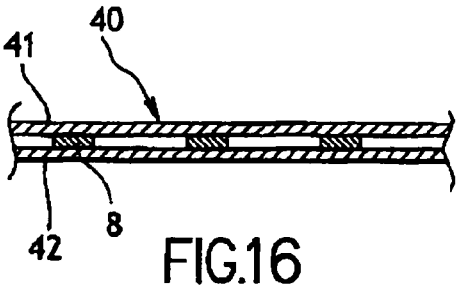
FIG. 16 is a diagrammatic and fragmentary cross-section view of a strip structure constituting another embodiment of the invention.

In another embodiment of the invention shown in FIG. 16, the security structure 40 for incorporation in a document comprises two semi-reflecting films 41 and 42, e.g. two iridescent films, having the information vector 8 disposed between them.

This can be achieved by printing ink onto one of the films 41 and 42, for example.

Figure 17:
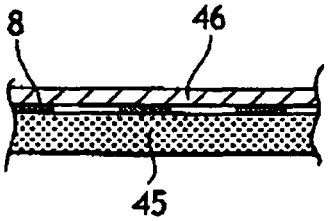
FIG. 17 is a diagrammatic and fragmentary cross-section view of a document constituting another embodiment of the invention.

In another variant, as shown in FIG. 17, the document 45 previously includes an information vector 8, e.g. made by printing ink on the document 45.

Thereafter, the information vector 8 is covered by a masking element 46, e.g. a semi-reflecting film, or a support carrying a semi-reflecting coating, which is placed on the document 45.

Figure 18:
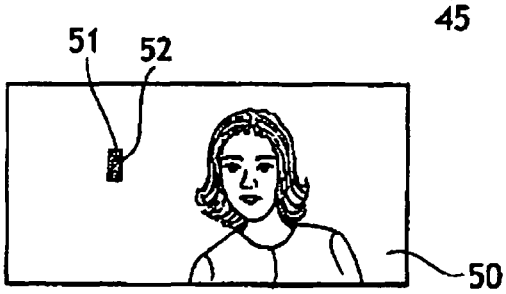
FIG. 18 is a diagrammatic and fragmentary view of a document in another embodiment of the invention.

FIG. 18 shows a security document and/or a document of value 50 constituting another embodiment of the invention.

The document 50, e.g. a banknote, has an information vector 51 on one face that is entirely covered by a masking element 52, constituted by a semi-reflecting coating.

In the example described, the information vector 51 carries information that is complete, i.e. information that can be revealed completely, independently of any other information vector. By way of example, the information may be a text.

The masking element 52 covers only a relatively small area of the document 50, forming a patch.

The information carried by the vector 51 is situated on one face only of the document 50.

The document 50 is made as follows.

Initially, a structure 54 is made comprising a support 55, e.g. made of polyester, carrying a plurality of elements 52 of semi-reflecting coating.

Figure 19:
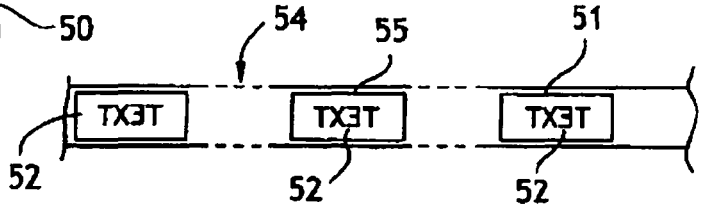
FIG. 19 is a diagrammatic and fragmentary view of a structure for being transferred in part onto the document of FIG. 18.

The elements 52 for transferring do not cover the entire area of the support 55, as can be seen in FIG. 19.

Each element 52 carries an information vector 51, e.g. made by negative printing.

The structure 54 is transferred in part onto the document 50, e.g. by local application of pressure and/or heat, such that the semi-reflecting element 52 becomes deposited on the document 50 together with the information vector 51.

Naturally, the invention is not limited to the embodiments described above.

The security element may in particular include any of the following elements, e.g. carried by a support on which the semi-reflecting coating is made:

an electronic chip;

a holographic and/or diffractive element;

a watermark;

a magnetic or crystalline coating;

liquid crystals;

printed varnish;

biomarkers;

a luminescent and/or fluorescent ink or substance; and thermochromic and/or piezochromic pigments.

The invention claimed is:

1. A security document and/or document of value comprising:

at least one information vector; and at least one masking element in the form of a strip having at least one semi-reflecting region covering the information vector at least in part, the masking element being of a width that is less than the width of the document, the masking element comprising a semi-reflective coating comprising one or more metals or iridescent pigments, the semi-reflective coating only being present over a fraction of the surface of the masking element.

2. A document according to claim 1, the masking element only being semi-reflecting over a fraction of its surface.

3. A document according to claim 1, the masking element including at least one light-opaque region surrounding a semi-reflecting window.

4. A document according to claim 1, the masking element being semi-reflecting over its entire surface.

5. A document according to claim 1, the semi-reflecting coating comprising dots or a screen.

6. A document according to claim 1, the semi-reflecting coating comprising dots or a screen where metal has been removed.

7. A document according to claim 1, the semi-reflecting coating comprising a layer of metal of thickness that is sufficiently small to enable light to be transmitted through said layer of metal.

8. A document according to claim 7, the thickness being in the range of 50 nm to 150 nm.

9. A document according to claim 8, wherein the thickness is close to 100 nm.

10. A document according to claim 1, the iridescent pigments being selected from extracts of mother-of-pearl; salts of lead; and micas.

11. A document according to claim 1, the semi-reflecting coating comprising dots or a screen of metal or where metal has been removed, implemented on the information vector.

12. A document according to claim 1, the masking element comprising a support.

13. A document according to claim 12, wherein the support is a flexible support on which the semi-reflecting coating has been deposited.

14. A document according to claim 12, the information vector being carried by the support.

15. A document according to claim 12, the support being transparent.

16. A document according to claim 12, comprising two supports with the information vector placed between them.

17. A document according to claim 12, the support being embedded in a layer of the document, at least in part.

18. A document according to claim 12, the support coming flush with a face of the document.

19. A document according to claim 1, including a multilayer structure transferred onto the surface of the document, the multilayer structure comprising a semi-reflecting coating and the information vector.

20. A document according to claim 1, the masking element comprising a semi-reflecting film, the information vector being carried by the semi-reflecting film or made by the document.

21. A document according to claim 20, the semi-reflecting film being an iridescent film.

22. A document according to claim 21, the information vector comprising a printing of an ink, the printing being negative or positive.

23. A document according to claim 22, the information vector carrying at least one of the following patterns: a word; a drawing; a symbol.

24. A document according to claim 23, the masking element including a plurality of semi-reflecting windows, and the windows and the patterns coinciding in regular manner.

25. A document according to claim 23, the masking element including a plurality of semi-reflecting windows and the windows and the patterns coinciding in irregular manner.

26. A document according to claim 1, the masking element having a thickness in the range of 6 μm to 60 μm.

27. A document according to claim 1, the masking element having a width greater than 0.7 mm.

28. A document according to claim 27, the width being in the range of 1 mm to 25 mm.

29. A document according to claim 1, including at least one fiber layer.

30. A document according to claim 1, having no pattern suitable for co-operating with the information vector masked by the masking element to define a composite pattern when the document is observed in transmitted light.

31. A document according to claim 1, constituting one of the following elements: a banknote; a coupon; a label for protecting a trademark or goods; a traceability label.

32. A security document and/or a document of value including:

at least one information vector carrying information that is complete; and at least one masking element having at least one semi-reflecting region completely covering the information vector, the masking element extending over a fraction only of one of the faces of the document, the masking element comprising a semi-reflective coating comprising one or more metals or iridescent pigments, the semi-reflective coating only being present over a fraction of the surface of the masking element.

33. A strip structure for being incorporated in or transferred at least in part onto a document of width greater than the width of the structure, the structure comprising:

at least one information vector; and at least one masking element having at least one semi-reflecting region covering the information vector at least in part, the masking element comprising a semi-reflective coating comprising one or more metals or iridescent pigments, the semi-reflective coating only being present over a fraction of the surface of the masking element.

34. A document according to claim 3, the masking element presenting varying width with edges that are not completely rectilinear, defining wider portions alternating with narrower portions.

35. A document according to claim 34, the masking element having windows situated in the wider portions.

36. A document according to claim 3, the masking element having semi-reflecting windows that extend on an area greater than the area on which the information vector extends.

37. A document according to claim 12, the masking element including a release layer between the support and the semi-reflecting coating.

* * * * *